US007497588B2

(12) United States Patent
Browder

(10) Patent No.: US 7,497,588 B2
(45) Date of Patent: Mar. 3, 2009

(54) STORE DISPLAY FOR SOLAR LAMP

(75) Inventor: John Browder, Roanoke, TX (US)

(73) Assignee: International Development Corporation, Roanoke, TX (US)

( * ) Notice: Subject to any disclaimer, the term of this patent is extended or adjusted under 35 U.S.C. 154(b) by 260 days.

(21) Appl. No.: 11/486,520

(22) Filed: Jul. 13, 2006

(65) Prior Publication Data

US 2007/0014104 A1 Jan. 18, 2007

Related U.S. Application Data

(60) Provisional application No. 60/711,814, filed on Aug. 26, 2005, provisional application No. 60/699,360, filed on Jul. 14, 2005.

(51) Int. Cl.
*F21L 13/00* (2006.01)

(52) U.S. Cl. ..... 362/192; 362/183; 362/147; 434/76

(58) Field of Classification Search ..... 362/192, 362/183, 147, 251; 211/26, 85.26; 40/473, 40/431; 434/76
See application file for complete search history.

(56) References Cited

U.S. PATENT DOCUMENTS

| | | | | |
|---|---|---|---|---|
| 5,055,984 | A * | 10/1991 | Hung et al. | 362/183 |
| 5,142,460 | A * | 8/1992 | McAtee | 362/249 |
| 6,963,275 | B2 * | 11/2005 | Smalls | 340/473 |
| 2006/0012978 | A1 * | 1/2006 | Allsop et al. | 362/183 |

* cited by examiner

*Primary Examiner*—Ali Alavi
(74) *Attorney, Agent, or Firm*—David W. Carstens; Carstens & Chaoon, LLP

(57) ABSTRACT

A system and method for the display of solar-powered light fixtures in a commercial setting is disclosed in the instant application. The solar-powered light fixture is contained within a box which minimizes the effect of the ambient light from the light fixtures illuminating the commercial establishment. A window is constructed in the box to permit a potential buyer to observe the operation of the solar light fixture. When ready to observe the operation of the solar light fixture, the potential buyer pushes a button which activates an electrical circuit, causing the solar light fixture to emit light.

11 Claims, 2 Drawing Sheets

STORE DISPLAY FOR SOLAR LAMP

CROSS-REFERENCE TO RELATED APPLICATIONS

Figure 1:
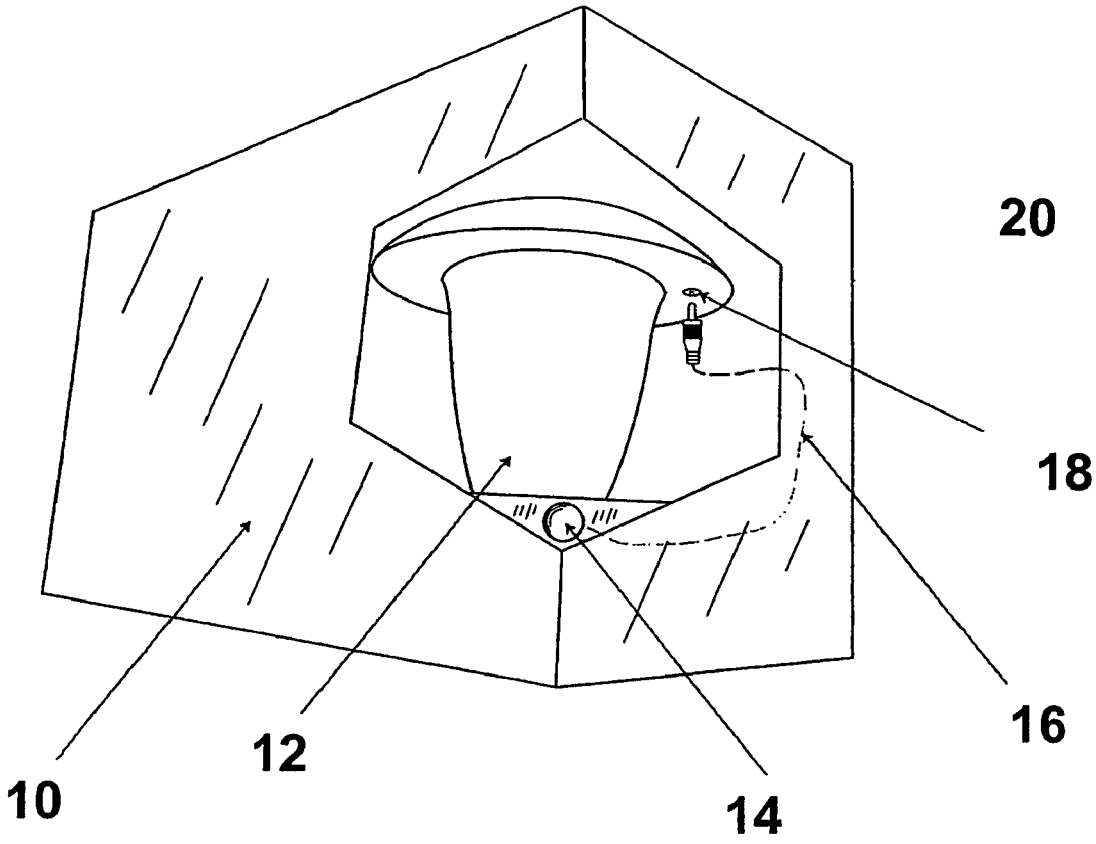

This application makes reference to and seeks the priority of U.S. Provisional Patent Applications No. 60/699,360 filed on Jul. 14, 2005 and No. 60/711,814 filed on Aug. 26, 2005.

STATEMENT REGARDING FEDERALLY FUNDED RESEARCH AND DEVELOPMENT

The invention disclosed in the instant application was not the subject of federally funded research or development.

FIELD

The present invention pertains to solar light fixtures; more particularly, the disclosed invention pertains to a system for display of a solar-powered light fixture in a store setting.

BACKGROUND

In recent years, the popularity of solar-powered apparatus has grown steadily. One of the most popular items is solar-powered lamps that homeowners use to mark such things as walkways or driveways. Another example of a solar item, including a lamp is a house number sign.

A frequent complaint of buyers of a solar-powered lamps is that the lamp is not bright enough or that the color of the light is not acceptable. It is difficult for a consumer to assess the intensity of the light emitted from a solar-powered light when examining the item at a well-lighted store. Similarly, it is difficult for a consumer to assess the color of light emitted by a solar-powered lamp in a well-lighted store.

Accordingly, there is a need in the art for a system which enables buyers of solar-powered lamps to assess the brightness of the light emitted from the lamp or the color of the emitted light before buying the solar light fixture.

SUMMARY

The store display for a solar lamp of the present invention enables buyers of solar-powered lamps to assess the brightness of the light emitted from the lamp or the color of the emitted light before buying the solar light fixture.

The invention disclosed herein is a box containing a solar powered lamp. On one side of the box is a window enabling a potential purchaser in a retail environment to observe the actual solar-powered light fixture within the box. The potential purchaser pushes a button located on the outside of the box and near the window. The act of pushing the button closes a circuit which permits electricity in an amount substantially equal to that supplied by the solar panel, to flow to the light fixture. By looking through the window of the box, the purchaser can assess the intensity of light and color of light emitted from the light fixture as if it were being illuminated by electrical energy obtained from the solar panel.

BRIEF DESCRIPTION OF THE DRAWING FIGURES

Figure 2:
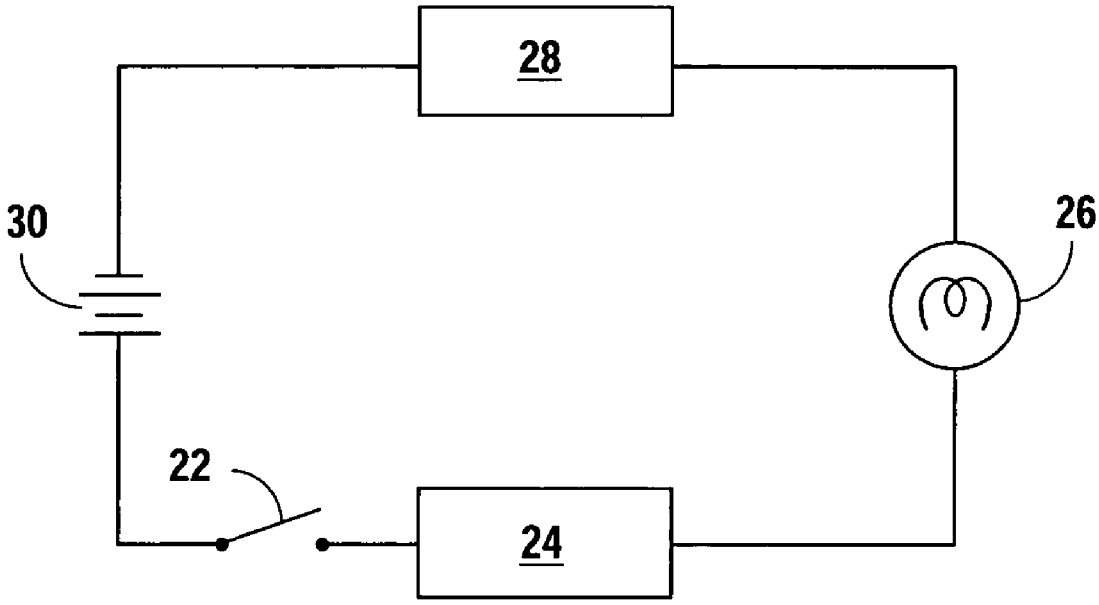

A better understanding of the store display system for solar lamps disclosed in the instant application may be had by examination of the following drawing figures wherein:

FIG. 1 is a drawing of the store display system for solar lamps and other solar powered apparatus; and FIG. 2 is an exemplary circuit diagram.

DESCRIPTION OF THE EMBODIMENTS

The ability of a purchaser to assess the intensity and color of light emitted by a solar-powered light fixture is often compromised by the ambient light emitted by the light fixtures of the store in which the solar-powered apparatus is sold. Because of the ambient light found in the store it is difficult to determine the amount of light that will be emitted by the solar-powered light fixture which may be used to illuminate a walkway, driveway or other dark place near a residence.

The invention disclosed herein enables a potential purchaser to assess the intensity and color of light emitted from a solar-powered light fixture. As shown in FIG. 1, the preferred embodiment of the present invention consists of a box 10, with a window 20 formed therein. The window 20 permits the buyer to see inside the box 10. Shown in FIG. 1 is a light fixture 12 inside the box. The box 10 shields the solar-powered lamp 12 inside the box from the ambient light emitted by the light fixtures of the building in which the box 10 is located. The light fixture 12 shown in FIG. 1 is of the type which could be hung either from a tree branch or a pole or mounted in the ground using a stake. Those of ordinary skill in the art will understand that the disclosed invention is suitable for use with a wide array of solar powered lighting fixtures.

The potential buyer looks through the window 20 into the darkened interior of the box 10 and when ready follows instructions on the box encouraging the potential buyer to push the "Try Me" 14 button which preferably is located next to the window. This "try me" button 14 is actually a switch which completes an electrical circuit that supplies power to the solar light fixture. The "try me" button 14 is connected to a power outlet 18 on the light fixture 12 by an electrical wire 16. The amount of power supplied to the solar light fixture is generally the same amount of power supplied to the light fixture by the solar panels located on top of the solar light fixture.

The electrical circuit for the store display for solar lamp system and method disclosed in the instant application is shown in FIG. 2. When the prospective buyer pushes the "try me" button 14, a switch 22 is closed completing the electrical circuit. When the electrical switch 22 is closed, electricity from the battery 30 flows through the circuit powering the voice recording 24, the timer 28 and the lamp 26. The timer 28 is set to turn off the lamp 26 at a predetermined time so as to not deplete the stored electrical energy in the battery 30.

In the simplest version, pushing the "try me" 14 button will cause the solar light fixture 12 to illuminate as long as the button 14 is pushed. In an alternate embodiment, the solar light fixture 12 will stay illuminated for a short period of time before the power is cut off. During this short period of time a pre-recorded message may be played either explaining more about the solar powered light fixture 12 or encouraging the customer to buy the solar-powered light fixture.

Other embodiments displaying other types of solar-powered light fixtures are enabled by the present invention. Those other light fixtures may include solar-powered: 1) lamps attached to the side of a house, 2) combination of lamp and insect eliminator, 3) house numbers and 4) illuminated bird feeders.

With regard to solar-powered house numbers, such house number displays typically include a translucent panel. Over the translucent panel are placed house numbers. Thus, when a lamp located behind the translucent panel is illuminated, the house numbers become visible. By placing a solar-powered house number display in a "try me" system as disclosed in the present application, the prospective buyer will quickly be able to understand the operation of the system and determine it's suitability to meet the buyer's needs.

Those of ordinary skill in the art will realize that the "try me" system as defined herein is similar to those now found on many non-solar powered items such as toys.

Further, those of ordinary skill in the art will recognize that there exist many other embodiments of the present invention not specifically disclosed. It is the intent of this application that those other embodiments be included within the scope and meaning of the appended claims.

What is claimed is:

1. A store display system for demonstrating the operation of a solar light fixture to a customer, said system comprising:

a box constructed and arranged to contain the solar light fixture and shield said light fixture from ambient light, said box including a window formed therein, which permits said customer to see inside the box;

a direct current electrical circuit for temporarily illuminating the solar light fixture;

said electrical circuit being activated by a consumer-operated switch;

whereby said consumer may activate said switch to observe and assess the brightness and color of said light fixture.

2. The store display system for a solar light fixture as defined in claim 1 wherein said light fixture is an outdoor lamp.

3. The store display system for a solar light fixture as defined in claim 1 wherein said electrical circuit includes a timer which turns off said light fixture after a predetermined time.

4. The store display system for a solar light fixture as defined in claim 1 wherein said system has a prerecorded message which is played when the consumer activates said switch.

5. The store display system for a solar light fixture as defined in claim 1 wherein said electrical circuit includes a voice recording mechanism, which produces a pre-recorded message when said electrical circuit is activated.

6. The store display system for a solar light fixture as defined in claim 1 wherein said direct current electrical circuit provides substantially the same amount of electrical power supplied by a solar panel used to power said light fixture.

7. The store display system for a solar light fixture as defined in claim 1 wherein said consumer-operated switch comprises a push-button switch.

8. A method for the display of a solar light fixture in a store comprising the steps of:

placing the solar light fixture in a box constructed and arranged to shield the solar light from ambient lighting in the store, said box including a window formed therein;

connecting said solar light fixture to an electrical circuit having a battery and a switch in the box containing the solar light fixture;

providing instructions to a customer in the store to close said switch thereby illuminating the light fixture using electrical energy from said battery;

whereby said customer may observe the brightness and color of light emitted from the solar light fixture through the window formed in said box by closing said switch.

9. The method for the display of solar light fixtures in a store as defined in claim 8 further including opening said switch thereby causing the electrical energy from said battery to the light fixture to be terminated after a predetermined period of time.

10. The method for the display of solar light fixtures in a store as defined in claim 9 wherein said opening step is automated.

11. The method for the display of solar light fixtures in a store as defined in claim 10 wherein said opening step is manually actuated.

* * * * *